US005471793A

United States Patent [19]

Magoon

[11] Patent Number: 5,471,793

[45] Date of Patent: Dec. 5, 1995

[54] ADJUSTABLE ASTRAGAL WEATHERING FOR OPERABLE DOORS AND WINDOWS

[75] Inventor: Robert D. Magoon, Duluth, Ga.

[73] Assignee: Kawneer Company, Inc., Norcross, Ga.

[21] Appl. No.: 349,619

[22] Filed: Dec. 5, 1994

[51] Int. Cl.[6] ..... E06B 7/16

[52] U.S. Cl. ..... 49/482.1; 49/493.1; 49/495.1

[58] Field of Search ..... 49/482.1, 493.1, 49/470, 495.1, 468

[56] References Cited

U.S. PATENT DOCUMENTS

| | | | |
|---|---|---|---|
| 2,105,164 | 1/1938 | Schlegel | 49/493.1 |
| 3,504,456 | 4/1970 | Frederick, Jr. | 49/482.1 X |
| 4,320,161 | 3/1982 | Redman | 49/495.1 X |
| 5,014,465 | 5/1991 | Ishikawa et al. | 49/482.1 |

OTHER PUBLICATIONS

2–sided sheet from 1989 Kawneer Catalog entitled "Standard Aluminum Entrances/190, 350, 500 Doors: The Designer's Element" describing several elements of the aluminum doors and Kawneer's Sealair Weathering System.

Executed Declaration of Robert D. Magoon Regarding Non–Documentary Prior Art with four (4) sheets of drawings attached.

*Primary Examiner*—Philip C. Kannan
*Attorney, Agent, or Firm*—Jones & Askew

[57] ABSTRACT

An adjustable astragal weathering for operable doors and windows is disclosed. The weathering comprises a carrier configured to be received within a groove formed in a lateral edge of a door or window. A weathering element is mounted to the carrier and projects outward therefrom. The head portion of a threaded fastener is configured to be received within a channel formed in the carrier. The head portion of the threaded fastener is captured within the channel such that tightening the threaded fastener will retract the weathering element into the lateral edge of the door and such that backing out the threaded fastener will extend the weathering from the lateral edge of the door.

10 Claims, 2 Drawing Sheets

ADJUSTABLE ASTRAGAL WEATHERING FOR OPERABLE DOORS AND WINDOWS

TECHNICAL FIELD

The present invention relates generally to weathering for operable doors and windows. More specifically, the invention relates to astragal weathering which is adjustable in height.

BACKGROUND OF THE INVENTION

Astragal weathering is weathering which is mounted to the edge of an operable door or window. Such weathering in typically used, for example, on the mutually adjacent edges of double doors or on the outside edges of revolving doors. Conventional astragal weathering comprises a metal carrier to which the weathering is mounted. While the type of weathering used will dependent upon the specific application, one widely used type of prior art astragal weathering includes a nylon pile weathering which backs an integral polymeric fin seal. The polymeric fin seal serves as the primary barrier against air and water, while the pile weathering sweeps dirt and stabilizes the fin seal.

Typically, astragal weathering is mounted within a groove formed in the lateral edge of the door such that the carrier is recessed within the groove, leaving only the weathering protruding beyond the edge of the door. The carrier is secured within the groove by a plurality of screws spaced along the length of the carrier. The threaded shanks of the screws are inserted through corresponding holes in the carrier and threaded into the door at the base of the groove.

To compensate for tolerances between the lateral edge of the door and the adjacent door or door frame, the astragal weathering must be adjustable to provide control over the distance by which the weathering protrudes from the edge of the door. If the weathering does not extend all the way to the adjacent door or door frame, the insulating characteristics of the weathering are compromised. If the weathering extends too far it will drag and hinder normal operation of the door or window. According to one conventional method of adjusting the height of prior art weathering, shims are interposed between the carrier and the base of the groove to adjust the height of the weathering. However, this method presents certain disadvantages in that it is often necessary to remove the weathering from its mounting channel to add shims. The mounting screws retaining the carrier of the weathering within the channel must be removed, the shims added, the carrier reinstalled within the channel, and the screws reinstalled through the carrier and into the door. This method of adjustment is time-consuming and labor intensive.

Thus there is a need for an adjustable astragal weathering wherein the distance by which the pile weathering protrudes beyond the edge of the door can be adjusted without having to remove the carrier from its mounting groove, insert shims, and reinstall the weathering.

According to another prior art arrangement of adjusting the height of the weathering, a portion of the metal carrier is bent to form a spring member which bears against the base of the channel and biases the carrier outward when the screws holding the carrier are loosened. However, problems also exist with this arrangement in that the spring member may become bent or broken during installation, may lose its resiliency over time, or may not exert an adequate force to overcome any friction or binding which may exist between the metal carrier and the channel in which it is mounted. In addition, even a minimal inward force directed against the astragal weathering will overcome the outward force exerted by the integral spring member and cause the weathering to move inwardly. Finally, another manufacturing step is involved in forming the metal carrier to include a spring member.

Thus there is a need for an adjustable astragal weathering wherein the distance by which the pile weathering protrudes beyond the edge of the door can be adjusted without the requirement for a spring member which may become bent or broken during installation, may lose its resiliency over time, or may not exert an adequate force to overcome any friction or binding which may exist between the metal carrier and the channel in which it is mounted. There is a further need for an adjustable astragal weathering which will not move inward in response to an inward force exerted against the weathering. There is still a further need for an adjustable astragal weathering wherein additional manufacturing steps are not involved in forming the metal carrier to include a spring member.

SUMMARY OF THE INVENTION

As will be see, the present invention overcomes these and other problems associated with prior art adjustable astragal weathering. The present invention comprises an adjustable astragal weathering wherein the distance by which the weathering extends beyond the edge of the door can be adjusted without having to remove the weathering from its mounting groove. Adjustment of the height of the weathering does not require shims or springs and can be performed quickly and easily. The weathering is held firmly within its channel and will not move inward in response to an inward force directed against the weathering. The weathering is not labor intensive or complicated to manufacture or to install.

Stated somewhat more specifically, the present invention comprises an adjustable astragal weathering for operable doors and windows. A carrier is configured to be received within a groove formed in a lateral edge of a door or window. Weathering is mounted to the carrier and projects outward therefrom. The head portion of a threaded fastener is configured to be received within a channel formed in the carrier. The head portion of the threaded fastener is captured within the channel such that tightening the threaded fastener will retract the weathering therewith and loosening the threaded fastener will extend the weathering therewith.

Thus it is an object of the present invention to provide an improved adjustable astragal weathering.

It is another object of the present invention to provide an improved adjustable astragal weathering which does not require shims, springs, or other separate components in order to adjust the height of the weathering.

Still another object of the present invention is to provide an improved adjustable astragal weathering which can be adjusted without having to remove the weathering from the door.

Yet another object of the present invention is to provide an improved adjustable astragal weathering which can be installed and adjusted quickly and easily.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
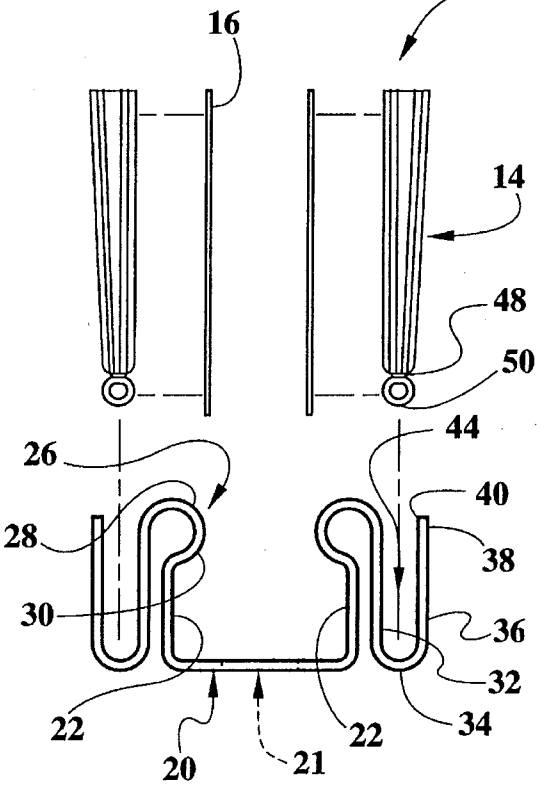
FIG. 1 is an exploded end view of the adjustable astragal weathering of the present invention.

Referring now to the drawings, in which like numerals indicate like elements throughout the several views, FIG. 1 is an exploded view of an adjustable astragal weathering 10 according to the present invention. The astragal weathering 10 comprises a carrier 12, pile weathering 14, and polymeric fin 16.

The carrier 12 is an elongated, roll-formed member of indeterminate length. In the disclosed embodiment the carrier 12 is comprised of aluminum 0.014 inches in thickness. The carrier 12 comprises a base 20 having a series of central, longitudinally spaced-apart clearance holes 21 punched therein at suitable intervals. The base 20 has a pair of upstanding legs 22 projecting outward from its lateral edges. The base 20 and upstanding legs 22 define a channel 24 therebetween. At the top of each upstanding leg 22, an inwardly extending lobe 26 projects into the channel 24. Each of the lobes 26 has an upper interior edge portion 28 and a lower interior edge portion 30.

Extending downward from the upper edge of each side wall 22 is a descending leg 32. At the bottom of each descending leg 32 a 180° bend 34 is formed, and exterior upstanding legs 36 extend upward therefrom. The exterior upstanding legs 36 each have an outer face 38 and an upper interior edge 40. The upper inside edge 40 of the exterior leg 38 is knurled, for reasons which will be explained below. The outer surface of each descending leg 32 and the inwardly facing surface of each exterior upstanding leg 36 forms a gutter 44 therebetween.

The pile weathering 14 of the disclosed embodiment is comprised of nylon fibers, specifically 200/3 Dacron® nylon. The nylon fibers are stitched together at a location 48 adjacent their lower ends 50. The polyester fin 16 of the disclosed embodiment is comprised of a polyester film 0.007 inches thick. The polymeric fins 16 are imposed against the inwardly facing edges of the pile weathering 14 and are stitched thereto at the stitching location 48.

Figure 2:
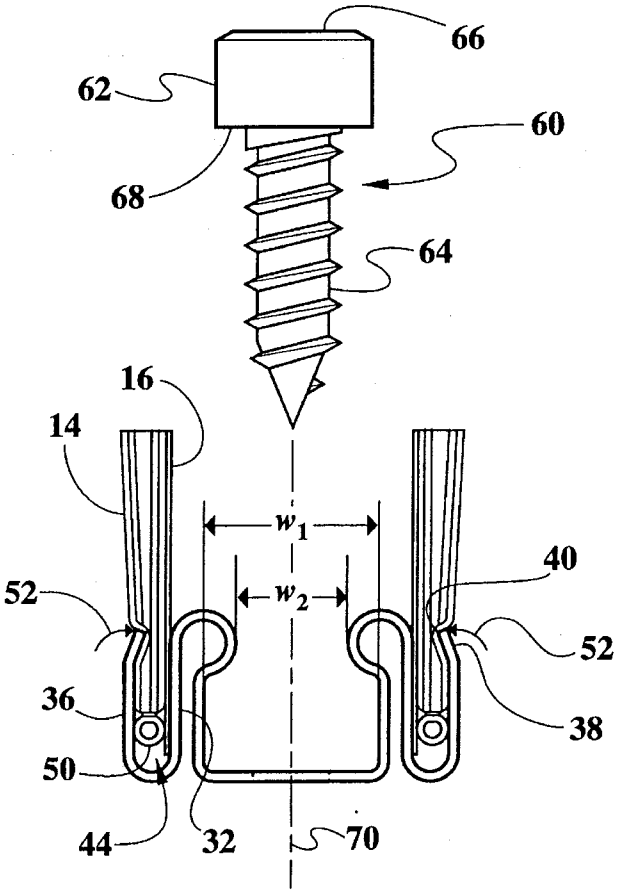
FIG. 2 is an end view showing the adjustable astragal weathering of FIG. 1 assembled and illustrating the installation of a mounting screw through the carrier of the weathering.

Referring now to FIG. 2, the lower end 50 of each pile weathering 14 and attached polymeric fin 16 is inserted into the gutter 44 defined between each descending leg 32 and exterior ascending leg 36 of the carrier 12. When the weathering has been inserted into the gutter 44, the lateral face 38 of the exterior ascending leg 36 is crimped inward in the direction shown by the arrows 52. This crimping causes the upper interior edge 40 of each exterior upstanding leg 36 to clamp the pile weathering 14 and polymeric fin 16 securely within the gutter 44. Also, as previously explained, the upper interior edge 40 of each exterior upstanding leg 36 is knurled. Thus when the upper interior edges 40 are crimped against the pile weathering 14 and integral polymeric fin 16, the knurled edge enhances the retention of the weathering within the gutter 44 and prevents longitudinal movement of the weathering within the gutter.

Referring further to FIG. 2, a mounting screw 60 has a head 62 and a threaded shank 64. The head 62 has an upper surface 66 and a lower surface 68. The upper surface 66 is configured for engagement by a tool for turning the screw, e.g., a flathead, Phillips head, or hex head screwdriver.

Figure 3:
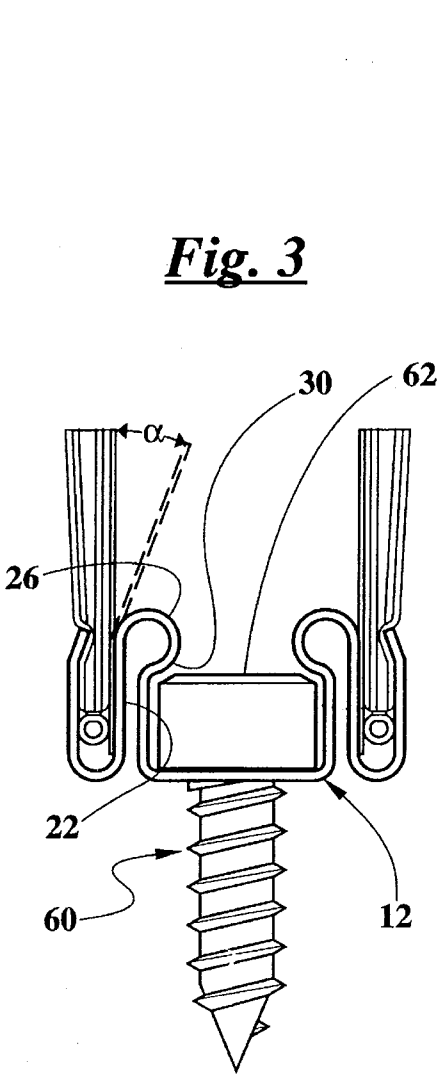
FIG. 3 is an end view of the adjustable astragal weathering and mounting screw of FIG. 2 showing how the mounting screw is assembled on to the carrier.

Of particular importance in the disclosed embodiment is the relationship between the dimensions of the head 62 of the mounting screw 60 and the dimensions of the channel 24 of the carrier 12. The diameter of the screw head 62 is less than the width $W_1$ of the channel 24 at its lower end, but is greater than the width $W_2$ of the narrowed neck portion at the upper end of the channel 24. Thus, when the threaded shank 64 of the mounting screw 60 is inserted through one of the bores 21 in the base 20 of the carrier 12, the lower edge 68 of the head 62 of the screw 60 will confront the upper interior surfaces 28 of the inwardly projecting lobes 26. As the screw 60 is advanced further, the pressure of the lower surface 68 of the screw head 62 on the inwardly projecting lobes 26 will cause the upstanding legs 22 to deform outwardly. As the mounting screw 60 is advanced further and the head 62 of the screw clears the inwardly projecting lobes 26, the upstanding legs 22 will spring back to their original positions, as shown in FIG. 3. In this configuration, the head 62 of the mounting Screw 60 is captured beneath the lower interior surfaces 30 of the inwardly projecting lobes 26.

Also of note in FIG. 3 is the fact that the polymeric fin 16 may be bent inward up to an angle $\alpha$ no greater than twenty degrees. Bending the fin 16 further risks compromising the sealing capabilities of the weathering 10.

Figure 4:
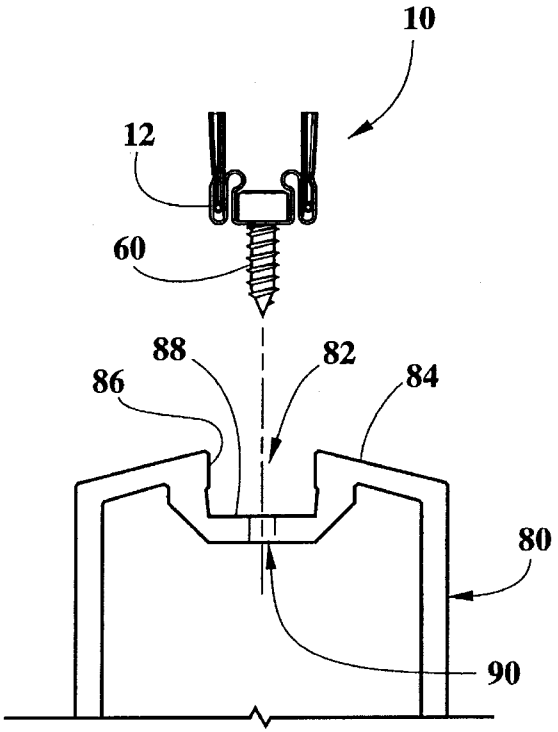
FIG. 4 is an end view of a door showing how the adjustable astragal weathering and mounting screw assembly of FIG. 3 is installed into a channel on the lateral edge of the door.

Turning now to FIG. 4, a door 80 has a mounting channel 82 extruded in a lateral edge 84 thereof. The channel 82 includes side walls 86 and a bottom wall 88 and is configured to receive the carrier 12 of the astragal weathering 10 therewithin. A plurality of bores 90 in the bottom wall 88 at spaced apart intervals along the length of the channel 82 correspond with the locations of the mounting screws 60. The astragal weathering 10 is mounted within the channel 82 in the lateral edge 84 of the door 80 by inserting the carrier 12 into the channel 82 and threading the screws 60 into their corresponding bores 90.

Figure 6:
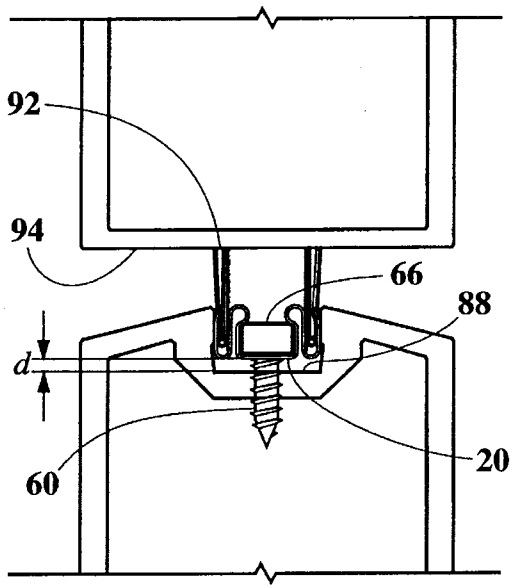
FIG. 6 is an end view of the door and stile of FIG. 5 illustrating how the height of the astragal weathering is adjusted to compensate for tolerances between the lateral edge of the door and the stile.
Figure 5:
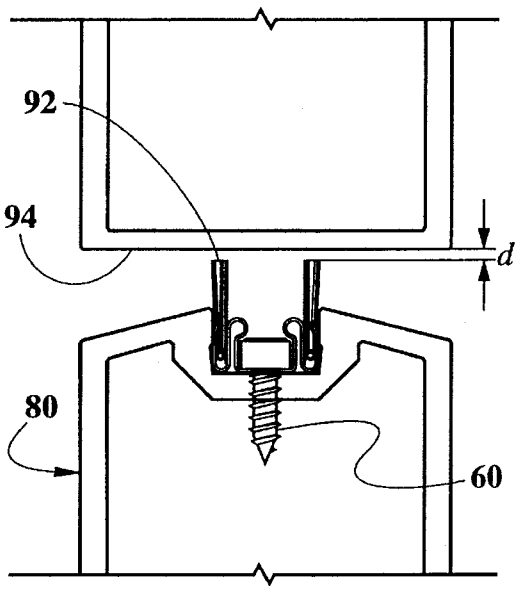
FIG. 5 is an end view of the door of FIG, 4 with the adjustable astragal weathering mounted onto the edge of the door but prior to the height of the weathering being adjusted with respect to an adjacent door stile.

Adjustment of the height of the astragal weathering 10 is illustrated with respect to FIGS. 5 and 6. In FIG. 5, the carrier 12 of the astragal weathering 10 is imposed against the bottom wall 88 of the channel 82, and the mounting screws 60 are threaded all the way in to their corresponding bores 90. Tightening the screws 60 results in the weathering 10 being retracted into the lateral edge 84 of the door 80. When the door 80 is mounted, it will be seen that the outer end 92 of the astragal weathering 10 fails to contact an adjacent door frame 94 by a distance d as shown in FIG. 5.

To extend the astragal weathering 10 from the lateral edge 84 of the door 80, a screw driver is used to back out the mounting screw 60. As the screw 60 is loosened, the upper edge 66 of the head 62 of the screw confronts the lower interior surface 30 of the inwardly projecting lobes 26 of the carrier 12, causing the carrier 12 to be backed away from the bottom wall 88 of the channel 82. The mounting screw 60 is backed out until the base 20 of the carrier 12 is spaced apart from the bottom wall 88 of the channel 82 by a distance d. In this position, the outer end 92 of the astragal weathering 10 rests closely against the door frame 94.

It will be noted that when the mounting screw 60 was first inserted into the carrier 12 of the astragal weathering 10, the pressure of the screw head 62 on the inwardly projecting lobes 26 of the carrier 12 caused the upstanding legs 22 to deform outward, permitting the screw head 62 to pass between the lobes 26. However, because of the close fit between the carrier 12 of the astragal weathering 10 and the side walls 86 of the corresponding mounting channel 82 in the lateral edge 84 of the door 80, the upstanding legs 22 are prevented from deforming outward. Accordingly, rather than spreading apart the lobes 26 as the screw 60 is backed out, the screw simply backs the carrier 12 out along with it. If it is ever necessary to remove a mounting screw 60 from the astragal weathering 10, screw removal can be accomplished by first removing the weathering 10 from the mounting channel 82. Without the side walls 86 of the mounting channel 82 to constrain outward deformation of the upstanding legs 22, withdrawing the mounting screw 60 with respect to the carrier 12 will cause the upper surface 66 of the screw head 62 to confront the inwardly projecting lobes 26 and spread the upstanding legs 22, permitting the screw 60 to be withdrawn from the carrier 12.

The improved astragal weathering 10 of the disclosed embodiment provides significant advantages over prior art astragal weathering. Because the screw heads 62 of the mounting screws 60 are captured within the channel 24 of the carrier 12, simply backing out the mounting screws will cause the carrier to be displaced away from the bottom wall 88 of the mounting channel 82. Thus it is not necessary to shim the carrier to maintain it in spaced apart relation to the bottom wall of the mounting channel 82. Since shimming is not required, removal of the carrier 12 from its mounting channel 82 and reinstallation of the carrier into the mounting channel are similarly not required. Thus a formerly labor-intensive procedure is greatly expedited and simplified.

In addition, the improved astragal weathering 10 of the disclosed embodiment does not rely upon a spring arrangement to bias the carrier outward. In contrast to the limited outward force exerted by a spring member, backing out the mounting screws will exert as much outward force as the installer can exert on the screwdriver.

While the foregoing embodiment has been disclosed with respect to a door, it will be appreciated that the weathering 10 can also be used with other pivotably mounted structures such as windows. Also, while the foregoing embodiment has been disclosed with respect to a door whose lateral edge lies adjacent a fixed door frame 92, it will be appreciated that the weathering 10 is equally well suited for other applications, including double doors wherein the lateral edge of the door lies adjacent the lateral edge of an adjoining door.

It will be appreciated that the terms "up," "down," "left," and "right" have been used herein for ease of description and are not intended to limit the invention to any particular orientation.

Finally, it will be understood that the preferred embodiment has been disclosed by way of example, and that other modifications may occur to those skilled in the art without departing from the scope and spirit of the appended claims.

What is claimed is:

1. An adjustable astragal weathering for mounting within a groove in a lateral edge of a door, comprising:

weathering mounted to said carrier and projecting outward therefrom;

a threaded fastener having a head portion configured to be received within said channel and a threaded shank portion for engaging a corresponding portion of said door when said carrier is received within said groove in said lateral edge of said door; and inwardly projecting lobes disposed on mutually facing portions of said means defining said channel, said inwardly projecting lobes being spaced apart from one another by a distance less than the diameter of said head of said threaded fastener, said inwardly projecting lobes comprising upper surfaces angled downward and inward such that when said head portion of said threaded fastener confronts said upper angled surfaces of said lobes, downward pressure exerted by said head of said threaded fastener will bias said lobes outward, thereby permitting said head of said threaded fastener to pass between said inwardly projecting lobes and into said channel, whereby when said carrier is received within a groove in said lateral edge of said door tightening said threaded fastener will retract said weathering into said lateral edge of said door and loosening said threaded fastener will extend said weathering from said lateral edge of said door.

2. The astragal weathering of claim 1, wherein said weathering comprises a pile weathering.

3. The astragal weathering of claim 1, wherein said inwardly projecting lobes further comprise lower surfaces angled upward and inward such that when said head portion of said threaded fastener confronts said lower angled surfaces of said lobes, upward pressure exerted by said head of said threaded fastener will bias said lobes outward, thereby permitting said head of said threaded fastener to pass between said inwardly projecting lobes and out of said channel.

4. The astragal weathering of claim 3, wherein said carrier is configured such that when said carrier is disposed within said groove in said lateral edge of said door, said lobes are constrained from being displaced outward, whereby said head of said threaded fastener cannot be withdrawn from said channel while said carrier is disposed within said groove.

5. An adjustable astragal weathering for mounting within a groove in a lateral edge of a door, comprising:

a carrier comprising:

a base member having lateral edges and a hole therethrough;

upstanding legs projecting upward from each of said lateral edges of said base member, said upstanding legs defining a channel therebetween, said base member forming a base of said channel;

lobes formed at upper edges of each of said upstanding legs and projecting into said channel;

descending legs projecting downward from an upper end of each of said upstanding legs; and ascending legs projecting upward from a lower end of each of said descending legs, each of said descending legs and a corresponding one of said ascending legs forming a gutter therebetween;

a pair of weathering elements each having an interior edge secured within one of said gutters and an exterior edge extending upward beyond said carrier;

a threaded fastener having a shank extending through said hole in said base member of said carrier and having a head portion disposed within said channel of said carrier, said head portion of said threaded fastener having a diameter less than the width of said base member and greater than the distance between said lobes;

whereby said head of said threaded fastener is captured within said channel beneath said lobes; and whereby tightening said threaded fastener will retract said weathering therewith and loosening said threaded fastener will extend said weathering therewith.

6. The astragal weathering of claim 5, wherein said interior edges of said weathering elements are secured within said gutters of said carrier by means of said ascending legs being crimped against said descending legs.

7. The astragal weathering of claim 5, wherein said weathering comprises pile weathering.

8. The astragal weathering of claim 5, wherein said lobes comprise upper surfaces angled downward and inward such that when said head portion of said threaded fastener confronts said upper angled surfaces of said lobes, downward pressure exerted by said head of said threaded fastener will bias said lobes outward, thereby permitting said head of said threaded fastener to pass between said inwardly projecting lobes and into said channel.

9. The astragal weathering of claim 8, wherein said lobes further comprise lower surfaces angled upward and inward such that when said head portion of said threaded fastener confronts said lower angled surfaces of said lobes, upward pressure exerted by said head of said threaded fastener will bias said lobes outward, thereby permitting said head of said threaded fastener to pass between said inwardly projecting lobes and out of said channel.

10. The astragal weathering of claim 9, wherein said carrier is configured such that when said carrier is disposed within said groove in said lateral edge of said door, said lobes are constrained from being displaced outward, whereby said head of said threaded fastener cannot be withdrawn from said channel while said carrier is disposed within said groove.

* * * * *